US011850534B1

(12) United States Patent
Altinsel

(10) Patent No.: US 11,850,534 B1
(45) Date of Patent: Dec. 26, 2023

(54) OBJECT LEVITATION KIT AND METHODS OF USE THEREOF

(71) Applicant: Penguin Magic, Inc., Rancho Cordova, CA (US)

(72) Inventor: Acar Altinsel, Rancho Cordova, CA (US)

(73) Assignee: Penguin Magic, Inc., Rancho Cordova, CA (US)

( * ) Notice: Subject to any disclaimer, the term of this patent is extended or adjusted under 35 U.S.C. 154(b) by 0 days.

(21) Appl. No.: 18/103,072

(22) Filed: Jan. 30, 2023

(51) Int. Cl.
*A63J 21/00* (2006.01)
*A63J 5/02* (2006.01)
*A63J 5/12* (2006.01)

(52) U.S. Cl.
CPC ..... *A63J 21/00* (2013.01)

(58) Field of Classification Search
CPC ..... A63J 5/00; A63J 5/02; A63J 5/12; A63H 27/00; A63H 33/26
USPC ..... 472/57, 26, 68, 72, 81
See application file for complete search history.

(56) References Cited

U.S. PATENT DOCUMENTS 5,254,077 A * 10/1993 Nottingham ..... A63H 27/082 473/589
5,409,420 A * 4/1995 Setteducati ..... A63H 15/00 472/68
2012/0208650 A1* 8/2012 Zealer ..... A63J 21/00 472/68

* cited by examiner

*Primary Examiner* — Kien T Nguyen
(74) *Attorney, Agent, or Firm* — POLSINELLI PC

(57) ABSTRACT

A magic kit and methods of use thereof are described. The magic kit may include a first handheld object and a second handheld object that appear to be identical but have different weights. The magic kit may be used to perform a magic trick where the second handheld object appears to levitate using an elastic band.

7 Claims, 1 Drawing Sheet

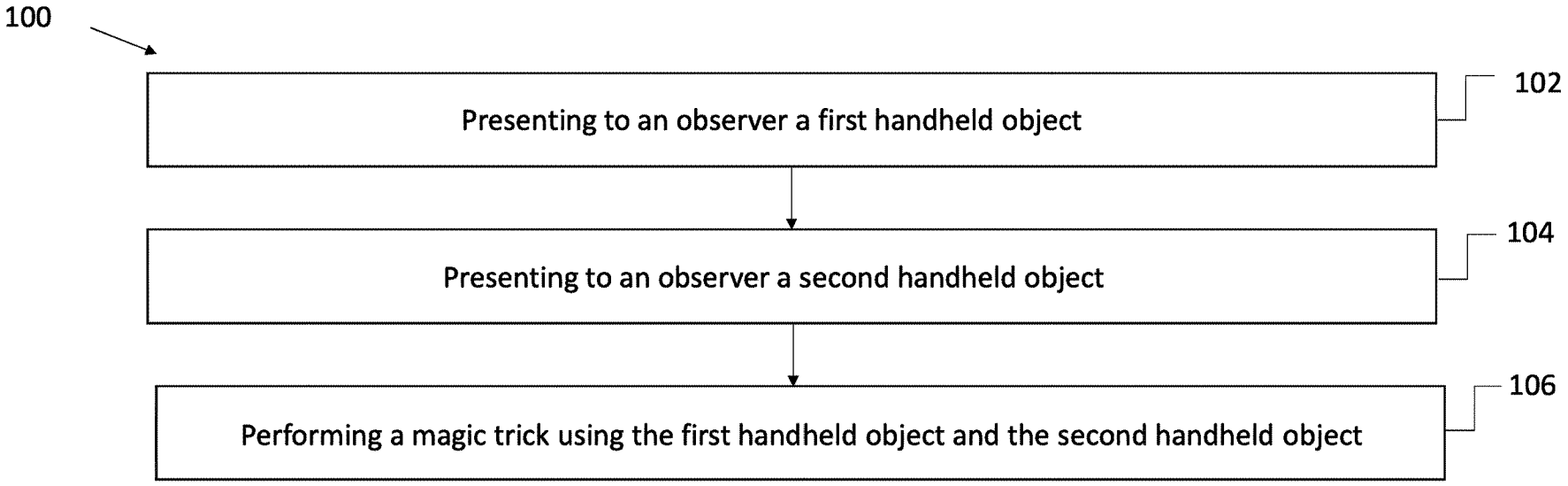
100
102
Presenting to an observer a first handheld object
104
Presenting to an observer a second handheld object
106
Performing a magic trick using the first handheld object and the second handheld object

OBJECT LEVITATION KIT AND METHODS OF USE THEREOF

FIELD

The present disclosure relates generally to a magic kit with objects to be used in a levitation magic trick. In at least one example, the present disclosure relates to a magic kit with a first handheld object and a second handheld object where the objects look identical, but the first handheld object has a greater weight than the second handheld object.

BACKGROUND

Magicians often perform magic tricks in close proximity to observers and let observers investigate items used in a magic trick. The magician may want to have objects that appear identical so that one can be used in the magic trick and therefore may be modified for use in the magic trick and another object can be inspected by an observer. However, objects with identical appearances but different weights have not previously been prepared or packaged in a kit due to the difficulty in preparing identical items with different weights. Objects with identical appearances but different weights have not previously been prepared because they are only useful to magicians. Magicians have not previously prepared or packaged the objects because the objects need to look like a real object but do not have to be real. The heavier object can be manufactured to appear like a "real" object when in fact it is not, and the lighter object can be manufactured to appear like a "real" object when in fact it is not.

As presented herein, a magic kit has been developed to overcome these problems.

BRIEF SUMMARY

Provided herein is a magic kit comprising two handheld objects. The magic kit may include two handheld objects having different weights.

An aspect of the present disclosure provides a magic kit comprising: a first handheld object comprising a first body having a first outer surface; and a second handheld object comprising a second body having a second outer surface. The first body has a weight that is greater than the second body. The first outer surface and the second outer surface are identical, such that the first handheld object and the second handheld object appear to be the same object but have different weights. The magic kit may have a packaging configured to contain both the first handheld object and the second handheld object.

In some aspects, the second handheld object is at least 50% lighter than the first handheld object. For example, the first handheld object has a minimum weight of about 0.25 pounds and the second handheld object has a maximum weight of about 0.25 pounds.

In additional aspects, the first handheld object and the second handheld object have at least one substantially planar surface. The first body and second body may be made of different materials. For example, the first body may comprise metal or any material the object the first handheld object appears to be is made of. The second body may comprise Styrofoam, plastic, or is hollow. The first body and the second body may be 3D printed.

In other aspects, the first body and the second body may be made of the same material. The first body may comprise a first core and the second body may comprise a second core, wherein the first core and the second core are made from different materials. The first outer surface and the second outer surface may comprise the same paint.

The magic kit may further comprise a plurality of elastic bands, wherein the elastic bands are packaged around an elastic band holder. The magic kit may have a packaging configured to contain the first handheld object, the second handheld object, and at least one elastic band having a thickness less than about 1 millimeter (mm).

Further provided herein is a method of using handheld objects for a magic trick, the method comprising: presenting to an observer a first handheld object comprising a first body having a first outer surface; presenting to the observer a second handheld object comprising a second body having a second outer surface, wherein the first body has a weight that is greater than the second body, and wherein the first outer surface and the second outer surface are identical, such that the first handheld object and the second handheld object appear to be the same object but have different weights.

In some aspects, the method further comprises elevating the second handheld object on an elastic band such that the second handheld object appears to levitate to the observer. In an example, the weight of the first body is too heavy to be levitated by the elastic band. The elastic band has a thickness of about 1 mm.

Other aspects and iterations of the invention are described more thoroughly below.

BRIEF DESCRIPTION OF THE DRAWINGS

Implementations of the present technology will now be described, by way of example only, with reference to the attached figures, wherein:

FIG. 1 is an example flowchart of the method for performing a magic trick.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. As used herein, "about" refers to numeric values, including whole numbers, fractions, percentages, etc., whether or not explicitly indicated. The term "about" generally refers to a range of numerical values, for instance, ±0.5-1%, ±1-5% or ±5-10% of the recited value, that one would consider equivalent to the recited value, for example, having the same function or result.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, "substantially cylindrical" means that the object resembles a cylinder but can have one or more deviations from a true cylinder.

The terms "comprising," "including" and "having" are used interchangeably in this disclosure. The terms "comprising," "including" and "having" mean to include, but not necessarily be limited to the things so described.

Provided herein is a magic kit for use in magic tricks. When performing magic tricks in close proximity to observers, it is often desirable to be able to let an observer inspect an object used or to be used in a magic trick. For example, an observer may hold and look at an object and thus also be able to feel the weight of the object. The magician may then make a second object, identical in appearance to the object inspected by the observer, "levitate." The observer may be more surprised by the magic trick because of the previous inspection, unaware that the second object used in the magic trick is significantly lighter than the object they inspected. The magic kit described herein includes a first handheld object and a second handheld object that have an identical outer appearance but have different weights. Because of the close proximity of the observer to the magician, it is important that the objects look identical and be packaged together.

In an embodiment, the magic kit may include a first handheld object and a second handheld object. The first handheld object may include a first body having a first outer surface, and the second handheld object may include a second body having a second outer surface. The first handheld object and the second handheld object may appear identical to an observer but have different weights. For example, the first outer surface and the second outer surface may appear identical, such that the first handheld object and the second handheld object appear to be the same object but have different weights. Therefore, if a magician switches out the first handheld object for the second handheld object, observers will not be aware of the switch when observing from a distance. In some examples, the heavier handheld object may be provided to an observer to hold and feel. The magician may then swap out the heavier handheld object for the lighter handheld object without being noticed by the observer. Then, the magician may perform a magic trick using the lighter handheld object, such as making the lighter handheld object "levitate" using one or more elastic bands. The magic trick may seem more surprising to the observer because the observer felt the heavier object, which the observer may have expected to be difficult to levitate.

In some embodiments, the first handheld object and the second handheld object have different weights. For example, the first body has a weight that is greater than the second body, or the second body has a weight that is greater than the first body. In various embodiments, the second handheld object is at least 10%, 20%, 30%, 40%, 50%, 60%, 70%, or 80% lighter than the first handheld object. In at least one example, the second handheld object is at least 50% lighter than the first handheld object. The first handheld object may have a weight of about 5 pounds, and the second handheld object may have a weight of about 0.25 pounds. In another example, the first handheld object may have a minimum weight of about 0.25 pounds. The second handheld object may have a maximum weight of about 0.25 pounds.

In some embodiments, the first handheld object may have a weight of about 0.25 pounds, about 0.5 pounds, about 0.75 pounds, about 1 pound, about 1.25 pounds, about 1.5 pounds, about 1.75 pounds, about 2 pounds, about 2.25 pounds, about 2.5 pounds, about 2.75 pounds, about 3 pounds, about 3.25 pounds, about 3.5 pounds, about 3.75 pounds, about 4 pounds, about 4.25 pounds, about 4.5 pounds, about 4.75 pounds, or about 5 pounds.

In some embodiments, the second handheld object may have a weight of about 0.01 pounds, about 0.05 pounds, about 0.1 pounds, about 0.15 pounds, about 0.2 pounds, or about 0.25 pounds.

In some embodiments, the first handheld object and the second handheld object may have at least one substantially planar surface. The substantially planar surface may assist with performing the magic trick, such as performing a magic trick with one or more elastic bands.

In an embodiment, the first body and the second body are made of different materials. In some examples, the first body may include any material that is heavier than the second body. For example, the first body may include metal, wood, paper, rubber, or any other material that the object the first handheld object represents would typically be made of. In other examples, the second body may comprise any material that is lighter than the material of the first body. For example, the second body may include Styrofoam, plastic, or may be hollow. Molds may be used to form the first body and the second body from different materials. Alternatively, the first and second bodies may be 3D printed. The first outer surface and the second outer surface may include the same surface application, coating, or paint to make the two handheld objects appear identical.

In some embodiments, the first body may be made of any material that the object the first handheld object represents is normally made of. The first handheld object may feel completely ordinary when held in a hand. For example, if the first handheld object appears to be a pencil, then the first body may be made of wood. If the first handheld object appears to be a rubber ball, then the first body may be made of rubber. If the first handheld object appears to be a metal object, then the first body may be made of metal. If the first handheld object appears to be a paper object, then the first body may be made of paper. If the first handheld object appears to be a wooden object, then the first body may be made of wood. If the first handheld object appears to be a rubber object, then the first body may be made of rubber.

In a further embodiment, the first body and the second body are made of the same material. The first body may have a first core and the second body may have a second core. The first core and the second core may be made of different materials. The first core may have a greater weight than the second core. For example, the first core may be made of materials with a greater weight than the material of the second core, such as metal, wood, paper, or rubber. The second core may be made of materials with a lower weight than the material of the first core, such as plastic or Styrofoam. Alternatively, the second core may be hollow. In another example, the second core may have a greater weight than the first core. The second core may be made of materials with a greater weight than the material of the first core, such as metal. In this example, the first core may be made of materials with a lower weight than the material of the second core, such as plastic, Styrofoam, or may be hollow.

In an embodiment, the first handheld object and the second handheld object may fit within a packaging configured to contain both the first handheld object and the second handheld object. The first handheld object and the second handheld object are packaged together because they are intended to be used together by the magician. In some embodiments, the packaging may further contain one or more elastic bands. The elastic bands may be configured to "levitate" the second handheld object in a magic trick. At least one elastic band may have a thickness less than about 1 mm. The elastic bands may appear "invisible" to an observer, such that a handheld object resting on or connected to one or more elastic bands may appear to be levitating without support. In some embodiments, the elastic bands may be packaged around an elastic band holder. The elastic band holder may be configured to hold 5, 6, 7, 8, 9, 10, 11, or 12 elastic bands. The elastic bands may be made out of a lycra-like elastic thread. The elastic bands may be made of elastane or other synthetic fibers. The elastic bands may be made out of any other elastic material.

In some embodiments, the elastic bands may have a thickness of about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 2 mm, about 3 mm, about 4 mm, about 5 mm, about 6 mm, about 7 mm, about 8 mm, about 9 mm, or about 10 mm.

Further provided herein is a method of using handheld objects to perform a magic trick. A flowchart as seen in FIG. 1 is presented in accordance with an example embodiment. The method 100 is provided by way of example, as there are a variety of ways to carry out the method. The method 100 described below can be carried out using the configurations illustrated in the figures, for example, and various elements of these figures are referenced in explaining example method 100. Each block represents one or more processes, methods or subroutines, carried out in the example method 100. Furthermore, the illustrated order of blocks in FIG. 1 is illustrative only and the order of the blocks can change according to the present disclosure. Additional blocks may be added or fewer blocks may be utilized, without departing from this disclosure.

The example method 100 is a method for performing a magic trick. The example method can begin at block 102. At block 102, the method includes presenting an observer with a first handheld object. In some examples, the first handheld object may have a first body and a first outer surface.

At block 104, the method includes presenting an observer with a second handheld object. In some embodiments, the second handheld object has a second body and a second outer surface.

In an embodiment, the first body has a weight that is greater than the second body. However, the first outer surface and the second outer surface may be identical, such that the first handheld object and the second handheld object appear to be the same object but have different weights. Therefore, the observer may be unaware that the second handheld object has been presented to them. For example, the first handheld object may be switched out for the second handheld object without the observer's knowledge because the objects appear identical from a distance. In some embodiments, the second handheld object may be at least 10%, 20%, 30%, 40%, 50%, 60%, 70%, or 80% lighter than the first handheld object. In at least one example, the first handheld object has a minimum weight of 0.25 pounds, and the second handheld object has a maximum weight of 0.25 pounds.

The first handheld object and the second handheld object may have at least one substantially planar surface. The substantially planar surface may assist with performing the magic trick, such as performing a magic trick with one or more elastic bands.

In some embodiments, the first body and the second body may be made of different materials. For example, the second body may be made of Styrofoam, plastic, or a combination thereof. In some examples, the second body is hollow. The first body may be made of metal or other material heavier than the material of the second body. Molds may be used to form the first body and the second body from different materials. Alternatively, the first body and the second body may be 3D printed. 3D printing with different resins or materials may allow for the objects to have an identical appearance but be made of different materials, giving them different weights. In other embodiments, the first body and the second body may be made from the same material but may have different cores. The first body may have a first core and the second body may have a second core. For example, the first core and the second core may be made of different materials such that the first core may have a greater weight than the second core.

In an embodiment, the first outer surface and the second outer surface may have the same paint and/or include the same material. The first outer surface and the second outer surface may include the same surface application, coating, or paint to make the two handheld objects appear identical.

In some embodiments, the method may include receiving a packaging with the first handheld object and the second handheld object prior to presenting either object to the observer. The packaging may further contain a plurality of elastic bands packaged around an elastic band holder. The elastic bands may be configured to "levitate" the second handheld object in a magic trick. At least one elastic band may have a thickness less than 1 mm. In some embodiments, the elastic bands may be packaged around an elastic band holder. The elastic band holder may be configured to hold 5, 6, 7, 8, 9, 10, 11, or 12 elastic bands.

At block 106, the method includes performing a magic trick. In an example, the magic trick may be performed by allowing the observer to inspect the first handheld object, switching the first handheld object for the second handheld object, and surprising the observer with the apparent levitation of the first handheld object. The first handheld object may be too heavy to be elevated by an elastic band, thus surprising the observer. In fact, it is the second handheld object that is levitated using the one or more elastic bands. In another example, the second handheld object may be elevated on one or more elastic bands such that the second handheld object appears to levitate to an observer. The elastic bands may appear "invisible" to an observer, such that a handheld object resting on or connected to one or more elastic bands may appear to be levitating without support.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A method of using handheld objects for a magic trick, the method comprising:

presenting to an observer a first handheld object comprising a first body having a first outer surface;

replacing the first handheld object with a second handheld object such that the observer is unaware that the first handheld object has been replaced by the second handheld object, the second handheld object comprising a second body having a second outer surface; and placing the second handheld object on one or more elastic bands, wherein the elastic bands cannot be seen by the observer; and elevating the second handheld object on the one or more elastic bands such that the second handheld object appears to levitate without support to the observer, wherein the second handheld object is at least 50% lighter than the first handheld object, and wherein the first outer surface and the second outer surface are identical, such that the first handheld object and the second handheld object appear to be the same object but have different weights.

2. The method of claim 1, wherein the weight of the first body is too heavy to be elevated by the elastic band.

3. The method of claim 1, wherein the elastic band has a thickness less than 1 mm.

4. The method of claim 1, wherein the first handheld object has a minimum weight of 0.25 pounds.

5. The method of claim 1, wherein the second handheld object has a maximum weight of 0.25 pounds.

6. The method of claim 1, wherein presenting to the observer comprises the observer inspecting the first handheld object.

7. The method of claim 6, wherein the observer holds and/or feels the weight of the first handheld object when inspecting the first handheld object.

* * * * *